US008087554B2

(12) United States Patent
Gringer et al.

(10) Patent No.: US 8,087,554 B2
(45) Date of Patent: Jan. 3, 2012

(54) MULTIFUNCTION POURING SPOUT WITH PIVOTING HANDLE

(75) Inventors: Donald Gringer, New York, NY (US); Yuan Fang Cheng, Forest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 1005 days.

(21) Appl. No.: 11/778,168

(22) Filed: Jul. 16, 2007

(65) Prior Publication Data

US 2007/0295768 A1 Dec. 27, 2007

Related U.S. Application Data

(63) Continuation-in-part of application No. 11/356,776, filed on Feb. 17, 2006, now abandoned, which is a continuation-in-part of application No. 10/830,275, filed on Apr. 22, 2004, now Pat. No. 7,134,576.

(51) Int. Cl.
*B65D 25/40* (2006.01)

(52) U.S. Cl. ..... 222/570; 222/465.1; 222/566; 220/696; 220/700; 220/701; 220/759

(58) Field of Classification Search ..... 222/566–571, 222/465, 1, 467; 220/695–702, 733, 755, 220/756, 759, 768–769, 230
See application file for complete search history.

(56) References Cited

U.S. PATENT DOCUMENTS 250,276 A * 11/1881 Morris ..... 222/465.1
1,698,403 A * 1/1929 Harris ..... 220/630
2,709,540 A * 5/1955 Kenney ..... 141/328
2,731,178 A 1/1956 Larsson
2,765,969 A * 10/1956 Bennington ..... 220/741
2,960,257 A * 11/1960 Sasse ..... 220/701
3,014,621 A * 12/1961 Povitz ..... 222/183
3,913,785 A 10/1975 Pattershall
4,898,297 A * 2/1990 Wheeler ..... 220/742
4,911,319 A 3/1990 DeJean
4,993,767 A * 2/1991 Song ..... 294/31.1
5,269,438 A 12/1993 Kelsey
5,505,330 A * 4/1996 Nunes ..... 220/742
5,582,321 A * 12/1996 Urbanczyk ..... 220/739
5,683,009 A * 11/1997 King ..... 220/696
5,853,107 A * 12/1998 Giwojna ..... 220/733
5,893,489 A 4/1999 Giarrante
5,913,450 A * 6/1999 Runkel ..... 220/696
(Continued)

*Primary Examiner* — Frederick C. Nicolas
(74) *Attorney, Agent, or Firm* — Gottlieb, Rackman & Reisman, P.C.

(57) ABSTRACT

An inventive pouring spout that is selectively attachable to a container and fitted to the opening of the container with which it is used. In a preferred embodiment, the pouring spout is fitted to the dimensions of a one-quart container and includes a wall, a sealing member, a mouth and a handle. The handle is connected to the wall with a hinge that enables the handle to pivot away from the container to allow the sealing member to be appropriately positioned while the container rests flat on a surface. After the sealing member is in place, the handle is then pivoted back in position to securely hold the container. The handle includes a plurality of upwardly extending projections adapted to securely engage the bottom rim of the container. Furthermore, thermoplastic material is applied at the handle area forming a handle cover that is comfortable and easy to grip. Thermoplastic material is also preferably utilized in the construction of the sealing member for forming a seal between the spout and opening of the container.

29 Claims, 14 Drawing Sheets

U.S. PATENT DOCUMENTS

| | | | | |
|---|---|---|---|---|
| 6,135,310 | A | 10/2000 | Svehaug | |
| 6,213,338 | B1 | 4/2001 | Cogdill | |
| 6,896,156 | B2 | 5/2005 | McDonald | |
| 7,134,574 | B2 * | 11/2006 | Braunstein et al. | 222/108 |
| 7,134,576 | B2 * | 11/2006 | Gringer et al. | 222/143 |
| 2004/0065698 | A1 | 4/2004 | Braunstein | |

* cited by examiner

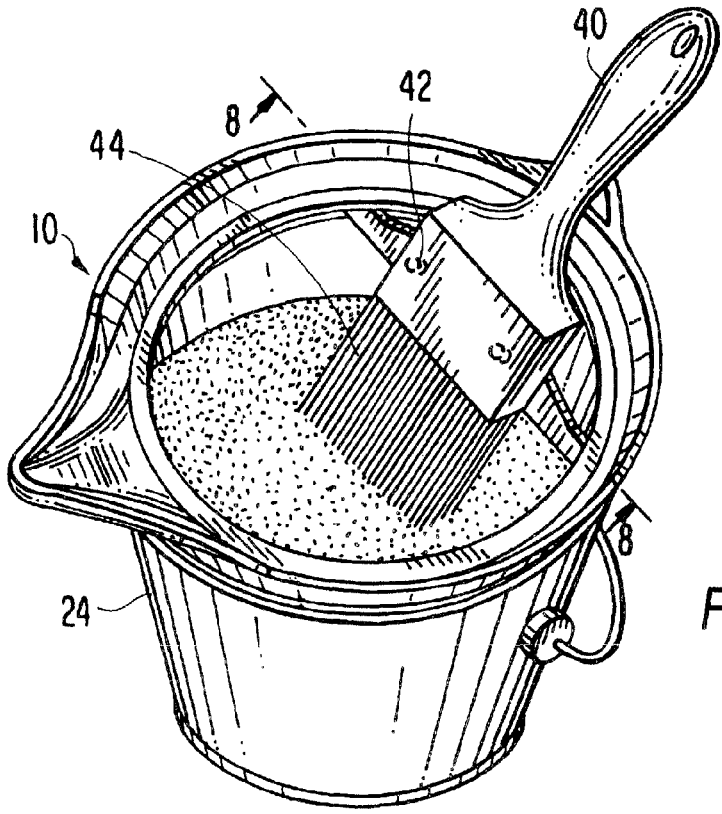
FIG. 7
FIG. 8
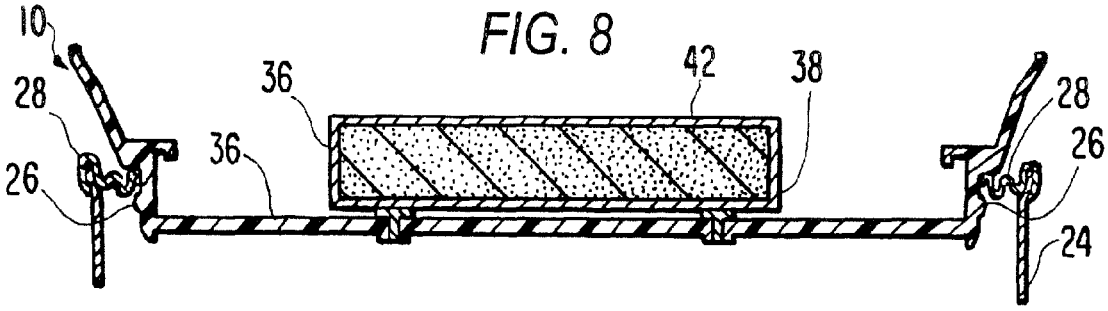

MULTIFUNCTION POURING SPOUT WITH PIVOTING HANDLE

RELATED APPLICATION

This application is a continuation-in-part application of application Ser. No. 11/356,776, filed on Feb. 17, 2006 now abandoned, which is a continuation-in-part application of application Ser. No. 10/830,275, filed on Apr. 22, 2004, now U.S. Pat. No. 7,134,576 and incorporated herein by reference.

FIELD OF INVENTION

This invention relates to a multifunction cover for containers, such as paint cans. More specifically, this invention involves a detachable pouring spout, optionally having a removable lid, which prevents the dripping and splashing of paint along the side and around the opening of a paint can. Furthermore, this invention involves, as another embodiment, a detachable pouring spout with handle which allows a user to easily hold on to a can of paint. Moreover, this invention involves, as yet another embodiment, a detachable pouring spout with handle, wherein the handle includes a hinge that allows the handle to pivot or otherwise move toward and/or away from the container to which the pouring spout is attached.

BACKGROUND OF THE INVENTION

For both the professional and casual painter, typical paint cans feature a multitude of drawbacks. Most notably, the construction of a typical one-gallon size paint can makes it virtually impossible to pour paint out of the can into a paint tray or other container without paint trickling down the sides of the can after the paint is poured. Excess paint dripping down the exterior of the can may cause undesirable paint smears on walls, floors, furniture and other items when the dripping paint accidentally comes in contact with one or more of these surfaces or objects. Further, the problem of paint running down the side of the can is aggravated when a user rests a wet paintbrush horizontally across the top of the paint can, as many painters typically do during a break. Paint from a wet paintbrush drips down the side of the can, causing similar problems noted above.

Further, there are a number of other common occurrences that often irritate painters and present additional difficulties. For instance, after paint is poured out of the can, a certain quantity always remains at the opening of the can in its sealing groove. The paint in this sealing groove poses the following problems: first, if the metal paint can lid is placed onto the can top and into the groove before the paint in it dries, the paint acts as an adhesive, sealing the lid to the can and making it more difficult to remove later on. In addition, when the cover is subsequently re-installed, paint in the sealing groove spatters as the lid is tapped down, causing paint to be dispersed randomly on the painter or on a surface.

Similarly, these problems are also encountered when dipping a paintbrush in a paint can and then wiping the brush against the inner rim of the can to remove excess paint from the brush. Although painters are aware of this problem, they choose to wipe the brush against the inner rim since the alternative (i.e., spreading the excess paint over a given area) may ruin the job at hand, thereby entirely undermining their efforts.

Moreover, although it is good practice to replace the paint lid on the can during a lunch break to keep the paint fresh, many fail to do so and introduce paint to the side of the can lid and in its sealing groove.

Another problem is that it is physically demanding to hold a paint can filled with paint by the wire handle that is provided on standard one-gallon paint cans due to the weight of the paint can when filled with paint. Moreover, since the handle is positioned directly above the opening of the suspended paint can when holding the can by the handle, it interferes with the dipping of the paint brush into the can thereby forcing a user to locate and orient the brush so that it does not come into contact with the paint can handle. Furthermore, in the context of smaller, one-quart paint containers where a handle is typically not provided therewith, it is particularly strenuous to continuously hold the can in a hand by outer side of the can without enduring muscle cramps and fatigue.

SUMMARY OF THE INVENTION

Accordingly, it is an object of the present invention to provide a detachable pouring spout for a paint can, which optionally includes a removable lid, that prevents the entry of paint into the sealing groove at the opening of the can and prevents the dripping of paint along the exterior surface of the paint can.

Another object of the present invention is to provide a detachable pouring spout for a paint can, which optionally includes a removable lid, that enables the removal of excess paint from a paint brush directly into the paint can without utilizing the interior rim of the can.

A further object of the present invention is to provide a means for storing a wet paint brush above a paint can that allows paint to be reintroduced to the interior of the paint can and prevents the paint from contacting the sealing groove of a paint can or its exterior surface.

Another object of the present invention is to provide a detachable pouring spout for a paint can, which includes a removable lid, that eliminates the need to re-install the original paint can lid between uses.

A still further object of the present invention is to provide detachable pouring spout for a paint can, which includes a removable lid, that enables multiple paint cans to be neatly stacked on one another, even when the pouring spout is engaged to the top of the paint can.

Yet another object of the present invention is to provide a detachable pouring spout with handle for a paint can which allows a user to easily hold a can of paint in one hand while simultaneously painting with the other.

Another object of the present invention is to provide a detachable pouring spout with handle for a paint can which allows the weight of a can of paint to be distributed over a larger surface area of the hand of a user thereby reducing muscle cramps and fatigue.

Still another object of the present invention is to provide a detachable pouring spout with handle for a paint can which prevents contact by a user's paint brush with and interference by standard wire paint can handles attached to a paint can.

Another object of the present invention is to provide a detachable pouring spout with a pivoting handle which allows the pouring spout to be easily installed onto a paint can or other container.

Additional objectives will be apparent from the description of the invention that follows.

In its broadest aspects, the invention involves a pouring spout for containers of liquid, which optionally has a removable lid or insert. The inventive pouring spout is preferably selectively attachable and detachable with respect to the container, and is fitted to the diameter of an opening of a particular container. In a preferred embodiment, the spout is fitted to the diameter of a paint can opening, where it may replace the typical lid of a paint can for the duration of its use.

The invention comprises a spout with a central opening that is selectively covered with a removable lid whether overnight, during a break or at any time when the paint from the can is not immediately needed. The spout includes a groove or a ridge at or near the base or lower edge of the spout which enables the spout to snap into the primary opening of the paint can. The spout fits snugly into the paint can, thereby preventing paint from being introduced to or within the sealing groove of the can. By utilizing the spout, paint from the can may instead accumulate on the spout, thereby relieving the problem of paint being accumulating at the sealing groove of the can and along the sides of the can. Further, the removable lid includes a receiving groove that does not collect paint, which enables the lid to snap into the central opening of the spout. This forms a tight seal over the paint can keeping the paint fresh and ready for use when needed.

In a preferred embodiment, the spout further comprises a bridging strip having an edge that allows a user to remove excess paint from the brush against the edge, thus simultaneously reintroducing the excess paint into the can. This strip allows a user to avoid wiping excess paint on the interior rim of the paint can, thereby further preventing paint from accumulating on the sealing groove.

Significantly, this same strip may also contain one or more magnets incorporated therein, so that after a wet paintbrush is used, the magnets attach to the metallic ferrule of the brush. Thus, the magnets hold the brush upright in place, allowing paint from the brush to drip back into the can, minimizing waste and maintaining cleanliness.

In another preferred embodiment, a detachable pouring spout is provided with a handle whereby the weight of the can is distributed over an increased surface area of the hand, rather than exclusively along the palm and fingers. More particularly, in the context of smaller-sized cans of paint, such as a one-quart paint can, the handle provided with the spout allows the weight of the can to be distributed in a number of additional areas of the hand, such as the area along the index finger and hand adjacent to the thumb, as well as the top surface of the hand opposite the palm. In an alternative embodiment of the pouring spout that is fitted with a handle, the handle includes a hinge member that allows the handle to pivot or otherwise move toward and/or away from the container to which the pouring spout is attached.

The pouring spout may be constructed of materials, including plastics and metals, which are well known in the art. Preferably, the pouring spout is injection molded from polypropylene and the optional removable lid is preferably constructed from polyethylene.

BRIEF DESCRIPTIONS OF THE DRAWINGS

FIG. 7 is a perspective view of a preferred embodiment of the pouring spout connected to a paint can and the ferrule of a paintbrush attached to two magnets located on the strip;

FIG. 8 is a partial cross sectional view of the ferrule of a paintbrush attached to two magnets located on the strip taken along line 8-8 of FIG. 7;

DETAILED DESCRIPTION OF THE INVENTION

Figure 1:
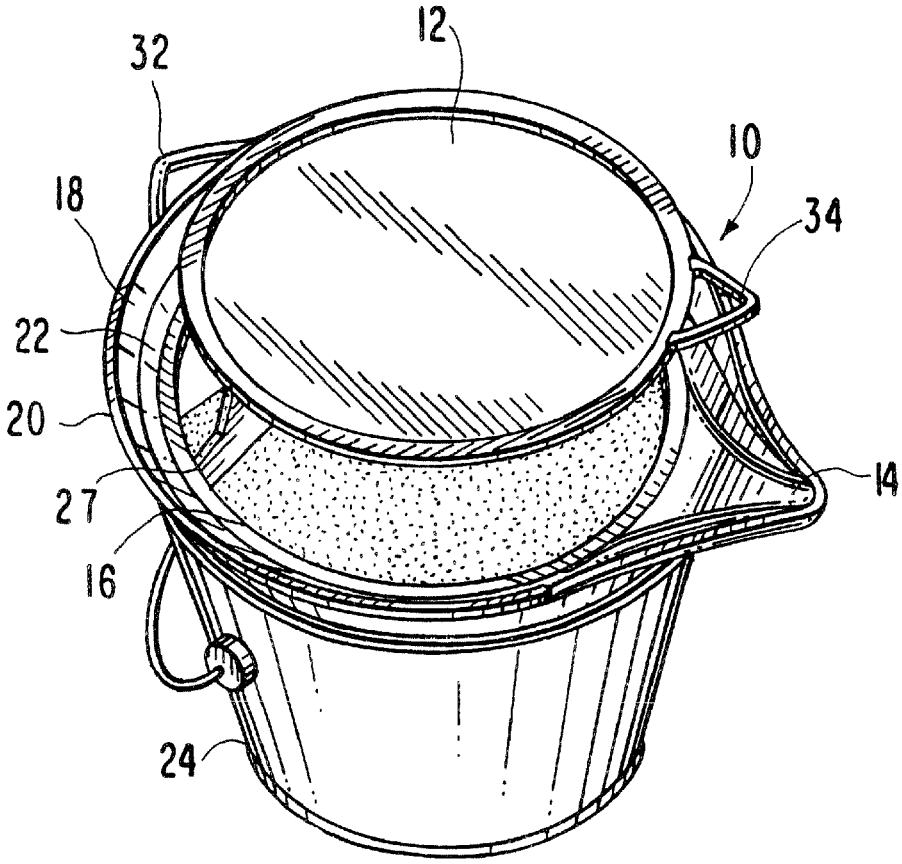
FIG. 1 is a perspective view of a preferred embodiment of the inventive pouring spout with removable lid connected to a paint can at its opening, the lid being slightly removed from the spout for ease of view.

Referring to the drawings, FIG. 1 depicts a preferred embodiment of the inventive pouring spout (10) having a removable insert or lid (12). Each spout (10) also has a mouth (14), a central circular opening (16) and a lateral surface which forms a wall (18) having an upper edge or rim (20) and a lower edge or rim (22). Preferably, the lateral surface proceeds at an angle greater than ninety degrees from horizontal, such that the wall (18) that is formed inclines outwardly and upwardly from the center and lower edge (22) of the spout (10). Of course, the lateral surface may run at an angle that is ninety degrees or less from a horizontal surface of a container as well. In addition to forming the wall (18) of the spout (10), the lateral surface also forms a mouth (14). The mouth (14) extends outwardly beyond the perimeter of the wall (18) forming a channel out of which liquid is poured from its container. As the channel extends away from the center of the spout (10), it gradually narrows, forming a triangular shape, thereby allowing the liquid to converge and be poured neatly from the spout (10). In the embodiment shown in FIG. 1, the spout (10) is fitted to the diameter of an opening of a paint (or other fluid) can (24) and is selectively attachable and detachable to it. Obviously, the pouring spout (10) can be fitted to openings having many other geometric shapes, including squares, rectangles and ovals. Further, the spout (10) and the container for which it is used may together form one solid unitary structure.

In a preferred embodiment shown in FIG. 1, the lower rim (22) of the pouring spout (10) fits the opening of the paint can (24) much like the standard metal lid used to cover the paint can (24) when it is sold at hardware stores. Accordingly, the spout (10) can be easily inserted into the opening of the paint can (24) once the metal lid is removed. Near the base of the spout (10), just above the lower rim (22), there is a channel or groove (26) around the perimeter of the spout (10) on the outside of the wall (18). The groove (26) enables the spout (10) to snap into place at the opening of the can (24) just as the lower rim (22) is inserted into the paint can (24). When the pouring spout (10) snaps into place, a seal is formed between the spout (10) and the sealing groove (28) of the paint can (24) (as shown in detail in FIG. 4), thereby preventing paint from coming into contact with the sealing groove (28). Other configurations may be provided to detachably engage the spout to a paint can.

Figure 2:
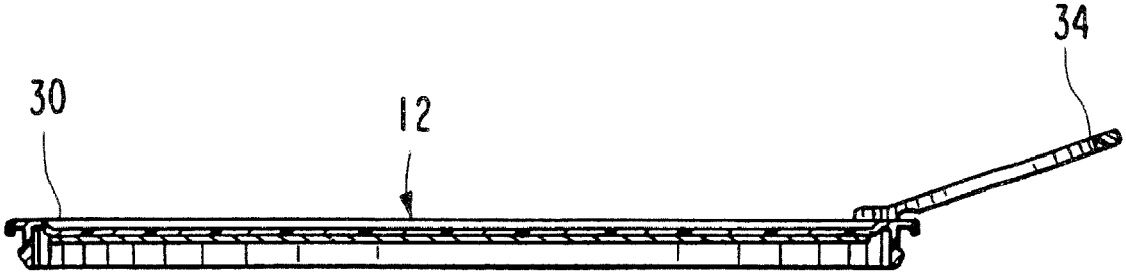
FIG. 2 is a side elevational view of the removable lid.
Figure 2A:
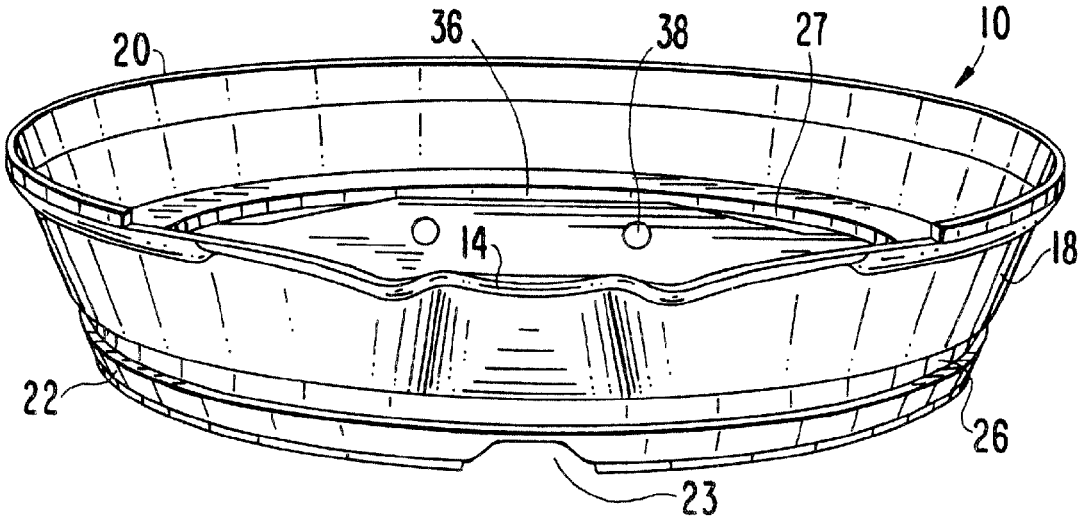
FIG. 2A is a front elevational view of the pouring spout without the removable lid.
Figure 2B:
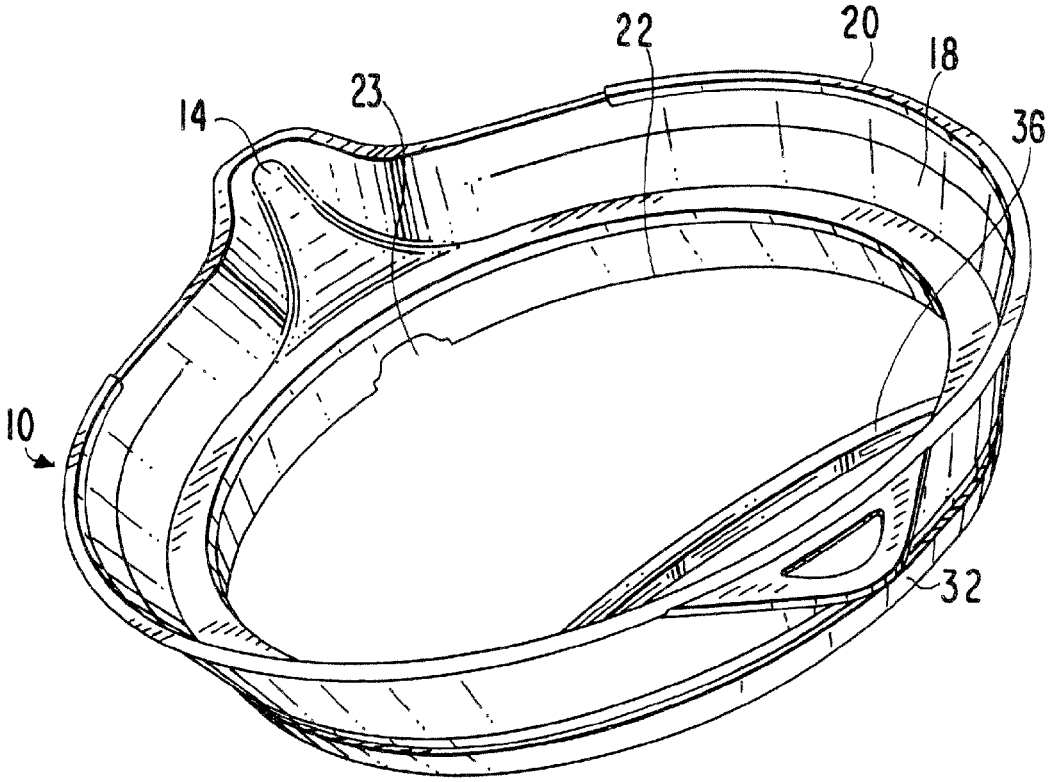
FIG. 2B is a top elevational view of the pouring spout without the removable lid.

Further, as shown in FIGS. 2A and 2B, the lower rim (22) of the pouring spout (10) incorporates a cutout (23) in the front of the spout (10), which allows the paint to flow relatively free from obstruction, thus permitting the flow of paint out the can when only minimal amounts of paint remain in the can.

The wall (18) of the spout (10) surrounds its interior and runs parallel to the circumference of the paint can (24). In case the can (24) is tilted at an extreme angle, the wall (18) prevents paint from spilling over the upper edge (20) of the spout (10) before it can exit out the mouth (14). Of course, other types of walls may be constructed, including walls of varying heights, walls that do not fully surround the interior of the spout (10) or walls which are not parallel to the circumference of the paint can (24). In addition the spout can also be constructed with more than one mouth or passageways out which paint or other liquids may flow. Moreover, a mouth or passageway may also be formed as gap in the wall or from a separate member attached to the wall as a means to assist the flow of paint or other liquid, rather than exclusively a structure that is created as an extension of the wall.

FIG. 1 shows a perspective view and FIG. 2 shows a side view of the removable lid (12) of the pouring spout (10). Generally, the lid (12) is sized to fit the central opening (16) of the pouring spout (10). Significantly, the lid (12) includes a groove or a lip (30) that continues around the perimeter of the lid (12), enabling it to snap into the central opening (16) of the spout (10). The spout (10) therefore preferably includes a protrusion (27) or other corresponding structure to accept the lid (12) and to maintain a tight fit. Obviously, other conventional locking means may be used to attach the lid (12) to the spout (10). After the spout (10) is engaged to the can (24), the lid (12) may close over the paint can (24), forming a seal and keeping the paint fresh for as long as it is not needed. Since the lid (12) is selectively removable, when paint is needed, the lid (12) is removed with little effort.

In a preferred embodiment, the spout (10) also incorporates one or more hangup loops (32), which preferably forms a triangular shape, by which a user can jerk the spout (10) out of the paint can (24) after the paint is exhausted or when the spout (10) is no longer needed. The removable lid (12) may also incorporate one or more hangup loops (34), also of a desirable triangular shape, by which a user can easily remove the lid (12) when the paint is ready to be poured from its can (24). When either the spout (10) or removable lid (12) is not in use, each may also hang by their respective hangup loops (32,34) on a hook or nail hammered into a wall. Obviously, each hangup loops (32,34) may be replaced by a tab (not shown) without an opening, by which a user may still pull the spout (10) from the paint can (24), or lid (12) from the spout (10).

Figure 3:
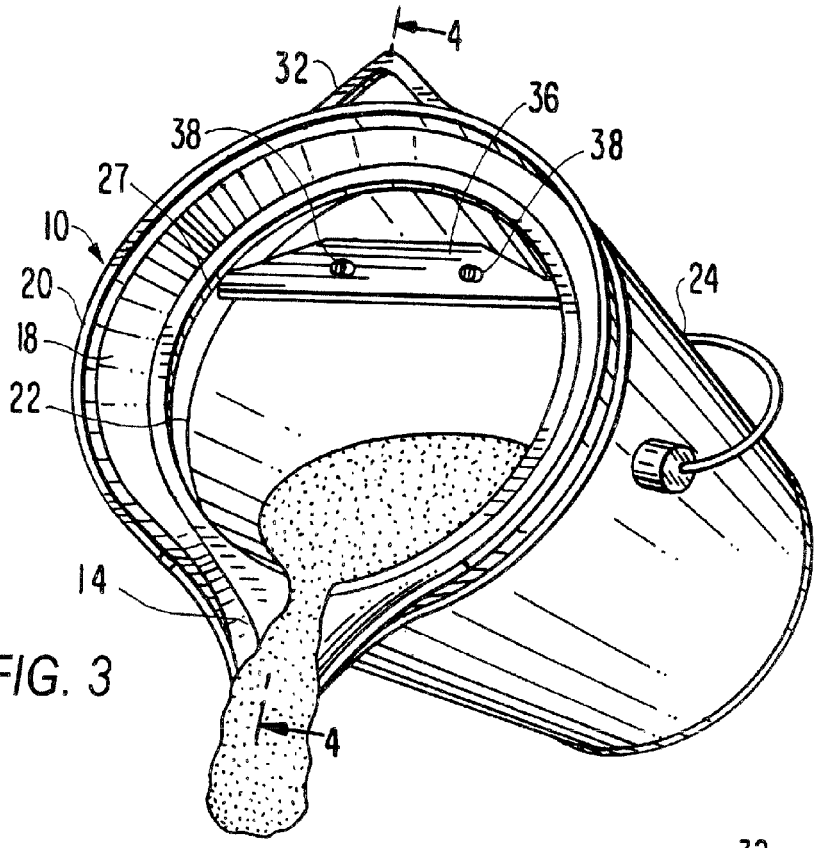
FIG. 3 illustrates paint being poured out of a paint can having a preferred embodiment of the inventive pouring spout connected thereto.
Figure 4:
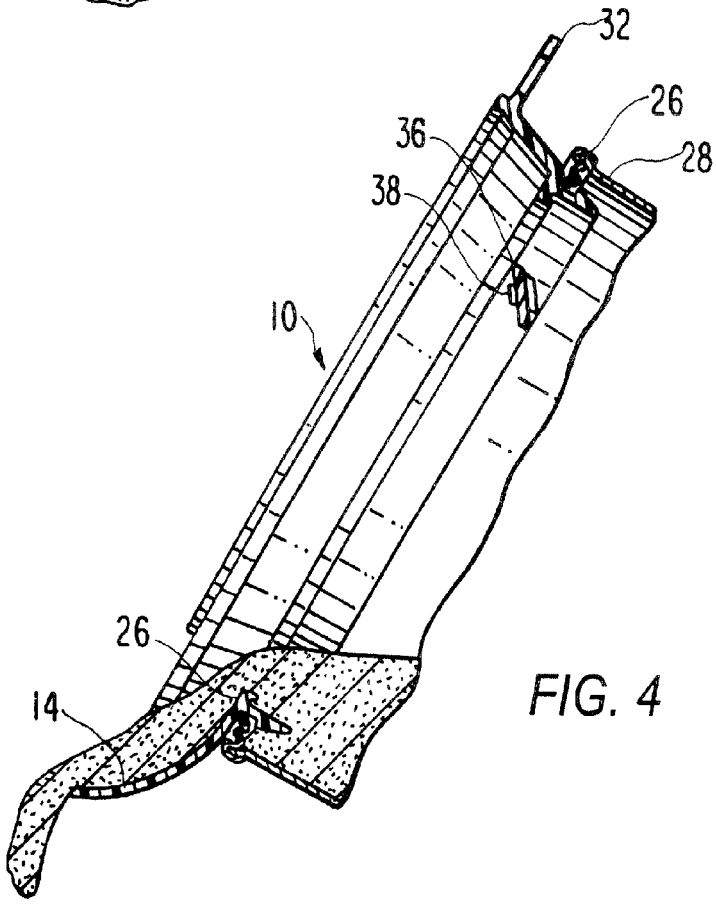
FIG. 4 is a partial cross sectional view of a preferred embodiment of the pouring spout connected to a paint can and paint pouring therefrom taken along line 4-4 of FIG. 3.

FIGS. 3 and 4 show paint being poured out of a can (24) that has a preferred embodiment of the pouring spout (10) attached thereto. As shown in more detail in FIG. 4, when the can (10) is tilted, paint enters the pout (10) at its lower edge (22) and continues through to the mouth (14) from where it is poured into another container (not shown). Importantly, the groove (26) of the spout (10), whose dimensions correspond to the sealing groove (28) of the paint can (24), allow paint from the can (24) to accumulate on the groove mouth of the spout (10) rather than the sealing groove (28) of the paint can (24).

Figure 5:
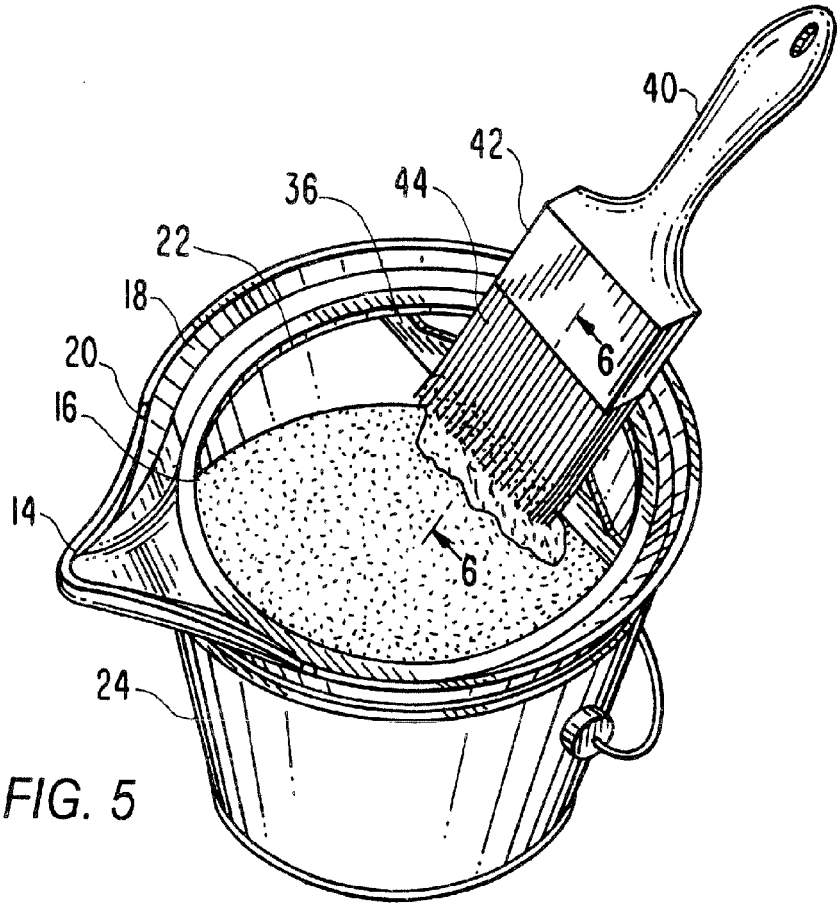
FIG. 5 is a perspective view of a preferred embodiment of the pouring spout connected to a paint can and a paintbrush being drawn against a strip, reintroducing excess paint into the paint can.
Figure 6:
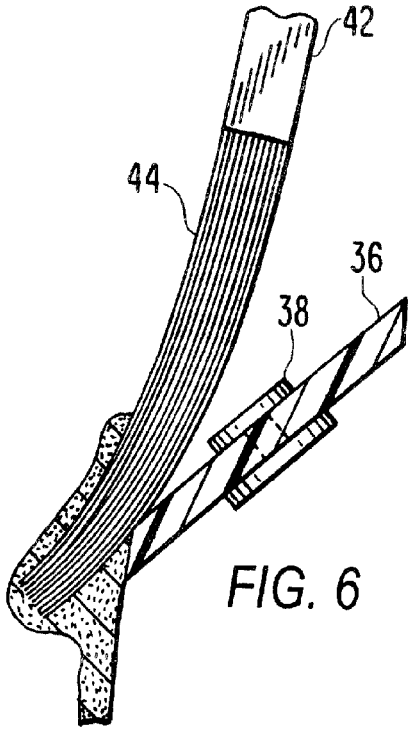
FIG. 6 is a partial cross sectional view of a paintbrush being drawn against a strip, thereby removing excess paint from the brush taken along line 6-6 of FIG. 5.

FIGS. 5 and 6 show a paintbrush (40) being drawn against a bridging strip (36) having a lower edge (37) that removes excess paint from the bristles (44) of the brush (40) as it is drawn. Essentially, the strip (36) approximates the function of a squeegee, coming in contact with the paintbrush (40) along a generally straight surface formed by its ferrule (42) and encased bristles (44). After the paintbrush (40) is dipped in paint, it is forced against the strip (36), thereby pushing some paint out of the brush (40), so that there is no excess paint on the brush. Of course, the strip (36) can also be used to force excess liquids or paint from other brush-type devices having a bristles attached thereto. In a preferred embodiment, the strip (36) is generally flat and thin and approximately one-half inch to one inch in width. The strip (36) also contains an angled edge (37) that helps remove excess paint. Further, the length of the strip (36) is generally dependent on the diameter of the central opening (16) and may be of a length corresponding to any line drawn from one point of the wall (18) to another. Moreover, in a preferred embodiment, the strip (36) is placed near the wall of the spout (10) (not in the center) and opposite the mouth (14) to help prevent paint from unnecessarily coming into contact with the strip (36) when the paint is poured. In addition, the strip (36) is also preferably located beneath the removable lid (12), since it has little use when the paint can (24) is covered to keep excess paint within the can and not on the lid.

Figure 6A:
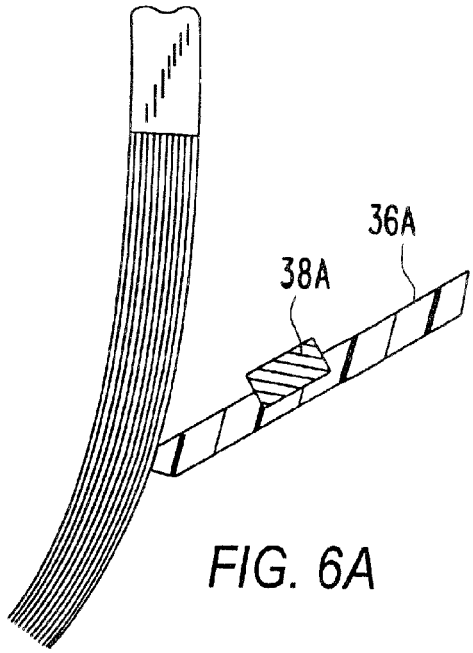
FIG. 6A is a partial cross sectional view of a paintbrush being drawn against another embodiment of a strip.

As depicted in FIG. 6A, another embodiment of the strip (36A) incorporates a double-angled edge (37A), wherein the top surface and bottom surface of the strip (36A) (37A) angle toward one another, forming the shape of an arrowhead.

Of course, other embodiments of the pouring spout may include, in place of the bridging strip, a surface that protrudes inwardly from the wall of the spout in place of the bridging strip (36, 36A). Such a surface can be constructed as an integral portion of the spout or can be a separate component that is attached to the spout by forming an interlocking groove on the surface and/or wall whereby the surface snaps into place on the wall or by using other conventional means including hooks, male-female snaps etc. In these other embodiments, the surface would also preferably include a straight edge. Further, the surface would also preferably be located beneath the removable cover or insert.

FIGS. 7 and 8 illustrate a preferred embodiment of the pouring spout (10) having one or more magnets (38), desirably two magnets, attached to the strip (36). Importantly, the magnets (38) are attached to the top of the strip (36) such that at least one surface of each magnet (38) is exposed. By exerting its magnetic attraction to the metallic ferrule (42), the magnets (38) suspend a paintbrush (40) over the opening of the paint can (24), allowing paint from the brush (40) to drip into the interior of the can (24).

The magnets (38) are attached to the strip (36) by conventional means well known in the art. Obviously, one larger magnet may be used in place of two or more magnets. As shown in FIG. 6A, the magnets (38A) may also be embedded in the strip (36A), leaving the upper surface of the magnets (38A) exposed.

Furthermore, instead of constructing a non-magnetic strip and attaching magnets thereto, one may also simply construct the spout (10) having a strip that is itself a magnet, thereby eliminating the need for attaching magnets to a strip. In addition, other means for suspending a paintbrush (40) over the can (24), including hooks and fasteners, may be used as well in connection with the invention.

Figure 9:
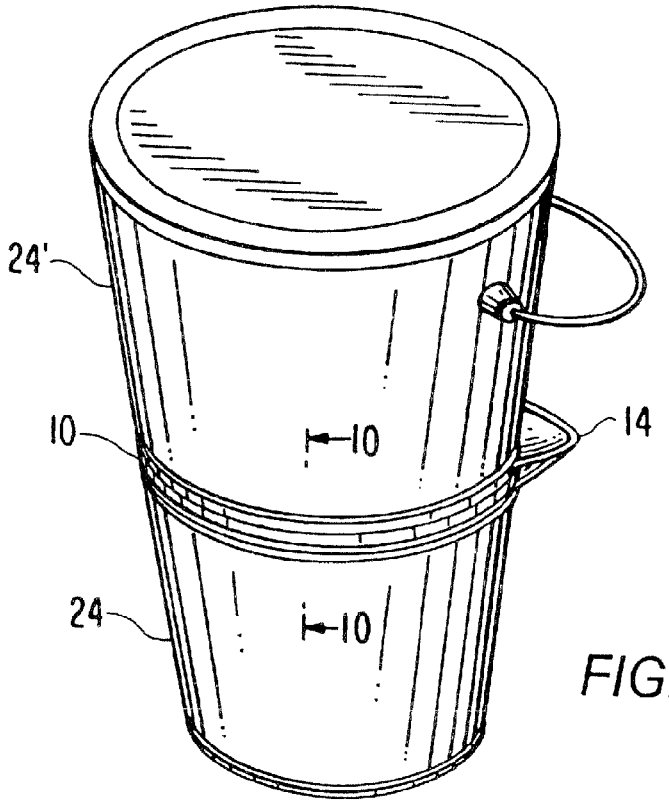
FIG. 9 is a perspective view of two paint cans stacked on top of one another, wherein the top can rests on the pouring spout that is inserted into the bottom paint can.
Figure 10:
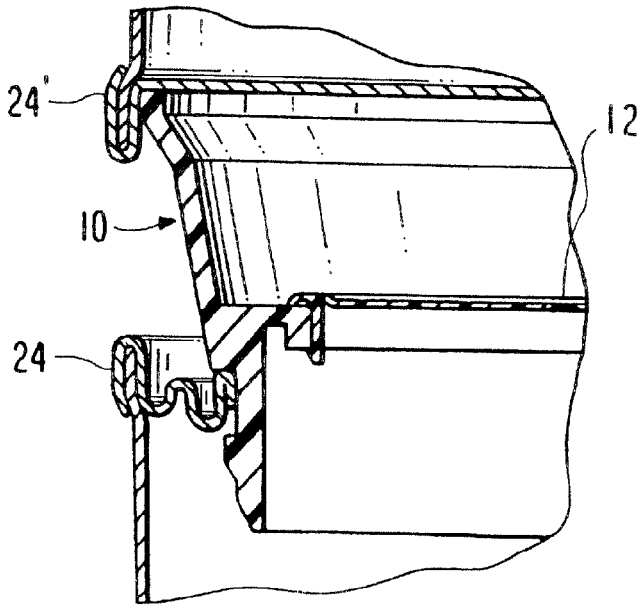
FIG. 10 is partial cross sectional view of the base of one paint can resting on a pouring spout that is inserted in the opening of another paint can taken along line 10-10 of FIG. 9.
Figure 11:
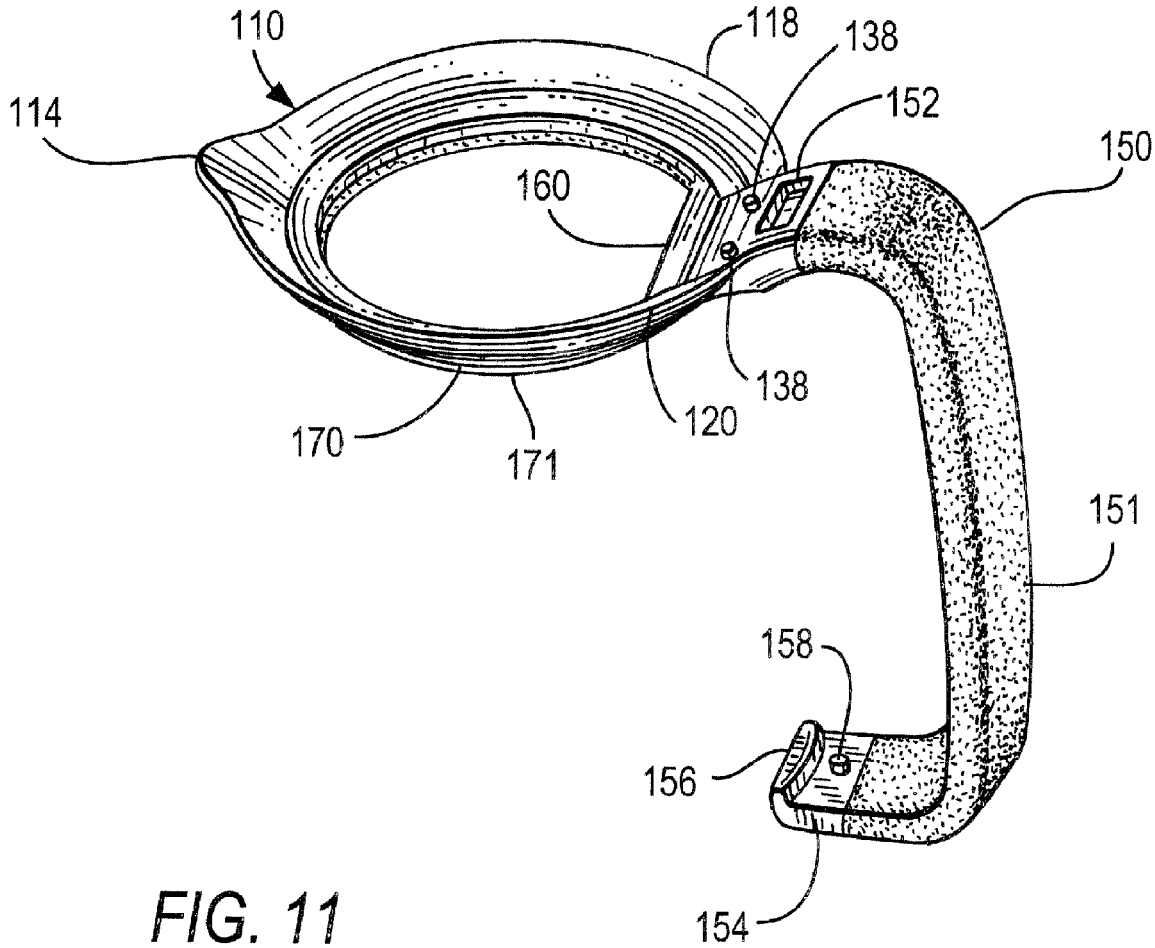
FIG. 11 is a perspective view of the pouring spout with handle separated from a paint can

FIGS. 9 and 10 depict two paint cans (24, 24') stacked on top of one another, wherein the top can (24') rests on the pouring spout (10) that is inserted into the bottom paint can (24). Thus, a preferred embodiment of the spout (10) possesses an upper rim (20) having a circumference corresponding to that of the typical paint can (24') resting on it, wherein the circumference of upper rim (20) is just slightly smaller than the circular base of the can (24'). This enables the can to rest on the upper rim (20) rather than at some point in the interior of the spout (10).

Obviously, the upper rim of the spout (10) may also form a circle that is larger than the base of the paint can (24'). In this embodiment, a step (not shown) is constructed just off the interior wall (18) of the spout (10), allowing the base of the paint can (24') to rest on the step, rather than the upper rim (20).

It should be noted that the inventive arrangement enables the functions of stacking cans, pouring liquid out of a container, easily removing a lid of a container holding liquid.

FIGS. 11 through 16 depict another preferred embodiment of the inventive pouring spout (110). The wall (118) of the spout (110) proceeds around and thereby defines a central opening, forming an aperture that is substantially aligned with the opening of a paint container (124). In this embodiment, the spout (110) has a mouth (114) which extends forward and radially outward from the wall (118) to which the mouth (114) is integrally connected, and a sealing member (171) at the lower edge or base (170) of the wall (118).

In this embodiment, the pouring spout includes a vertically-oriented, elongated, curved handle (150), located radially opposite the mouth (114) and having an overlay or cover (151) (later described). The top end (152) of the handle is attached to the wall (118) of the spout (110). Alternatively, the handle (150) may be attached at any other conventional location along the spout (110), including but not limited to, the inner or outer surface of the wall (118) of the spout (110), the upper rim (120), or a combination thereof. In the preferred embodiment, the handle (150) is integrally molded to the wall (118) of the spout (110) and connected to the wall (118) at the top end (152) of the handle (150). Other means for attaching the handle (150) to the wall (118) of the spout (110), or at other locations thereof, may be utilized as well.

Figure 12:
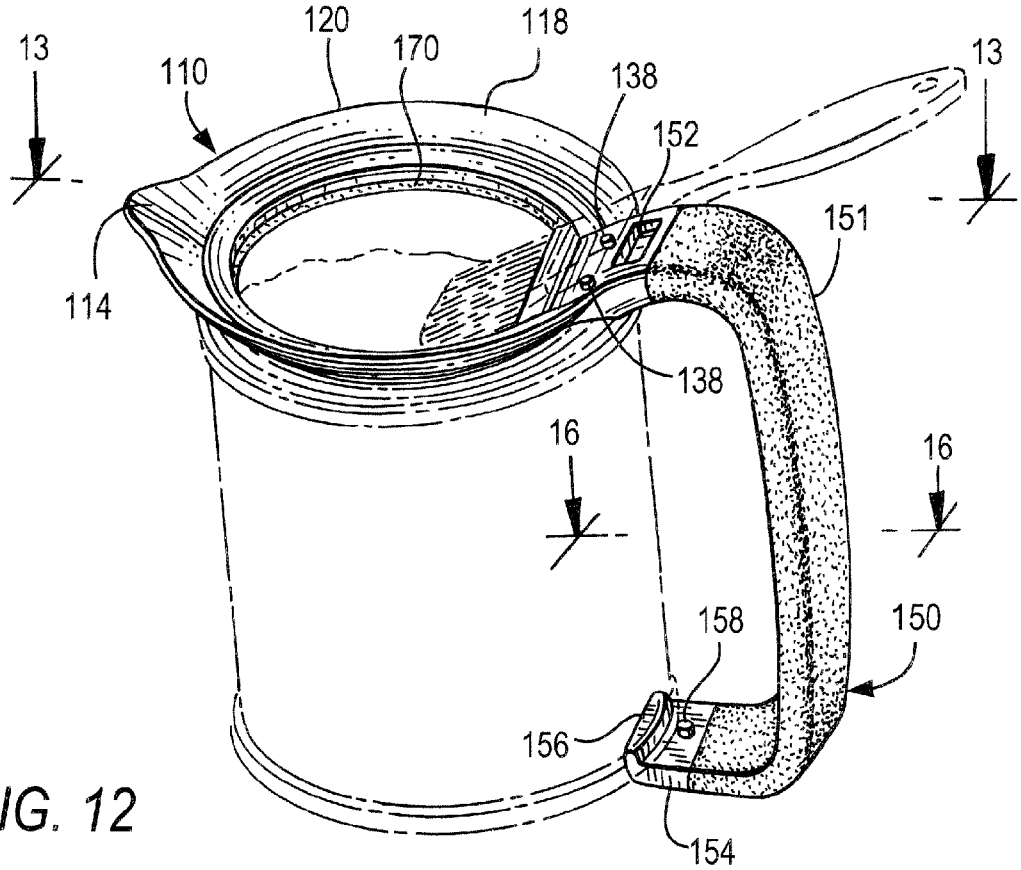
FIG. 12 is a perspective view of a preferred embodiment of the pouring spout with handle connected to a one-quart paint can at its opening.
Figure 16:
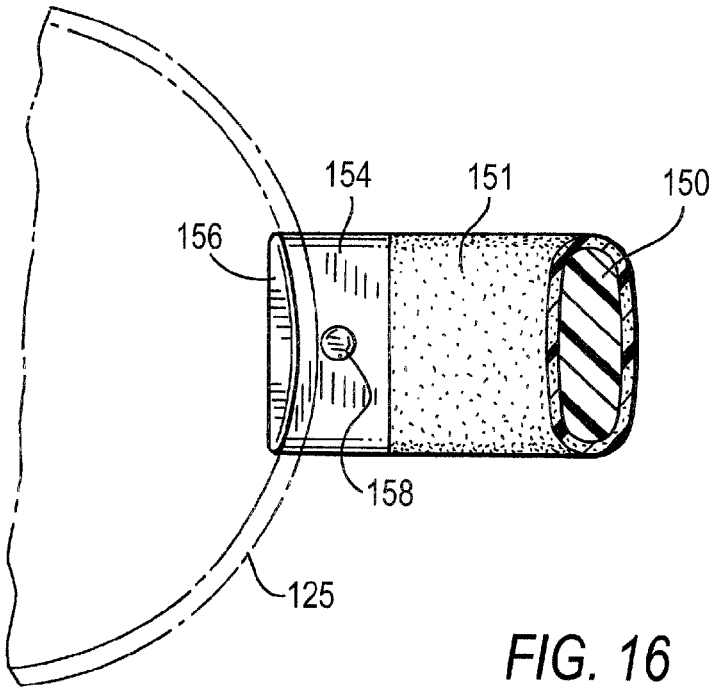
FIG. 16 is a partial cross sectional view of the pouring spout with handle taken along line 16-16 of FIG. 12.
Figure 13:
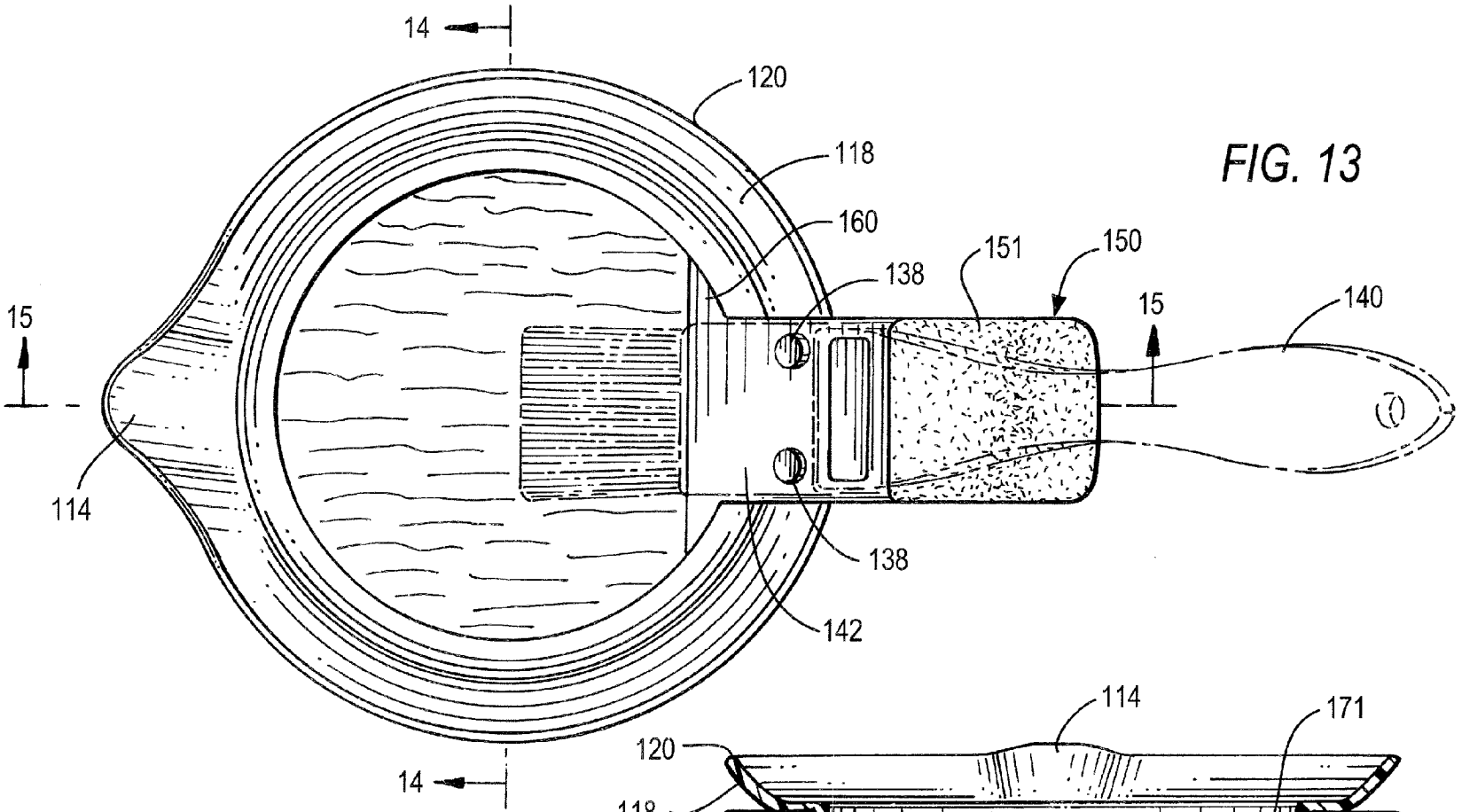
FIG. 13 is a top view of the pouring spout with handle taken along line 13-13 of FIG. 12.
Figure 14:
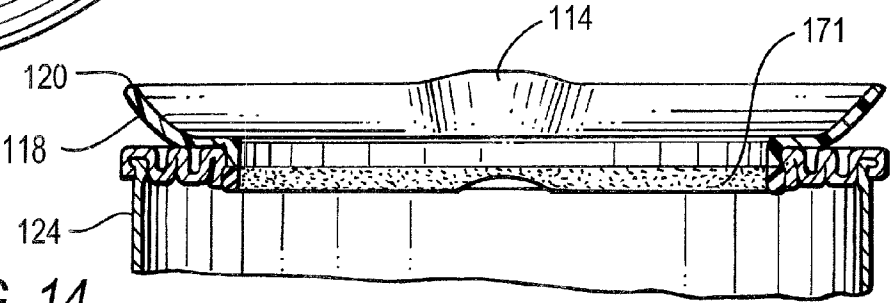
FIG. 14 is a partial cross sectional view of the pouring spout with handle taken along line 14-14 of FIG. 13.
Figure 15:
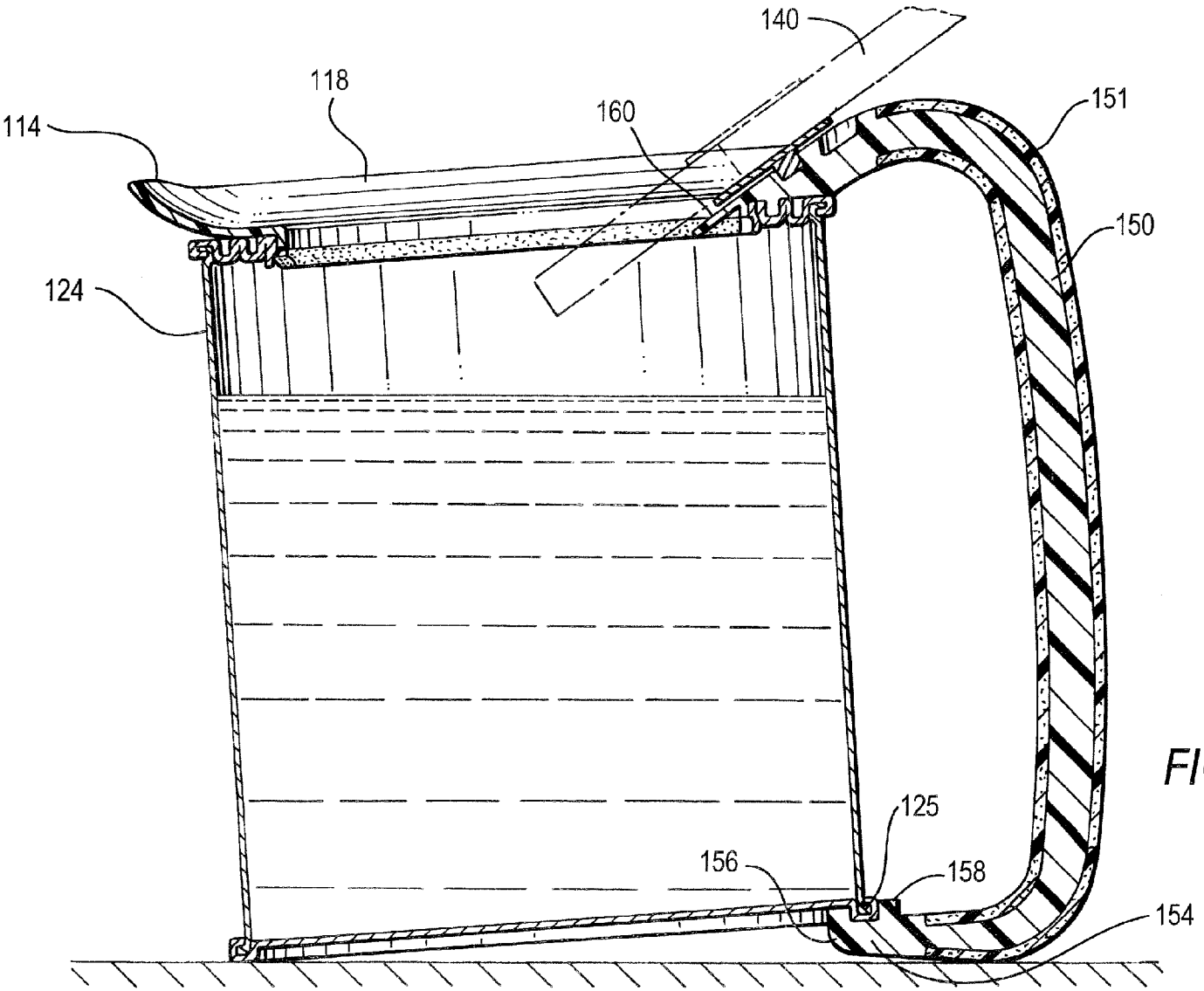
FIG. 15 is a side cross sectional view of the pouring spout with handle taken along line 15-15 of FIG. 13.
Figure 17:
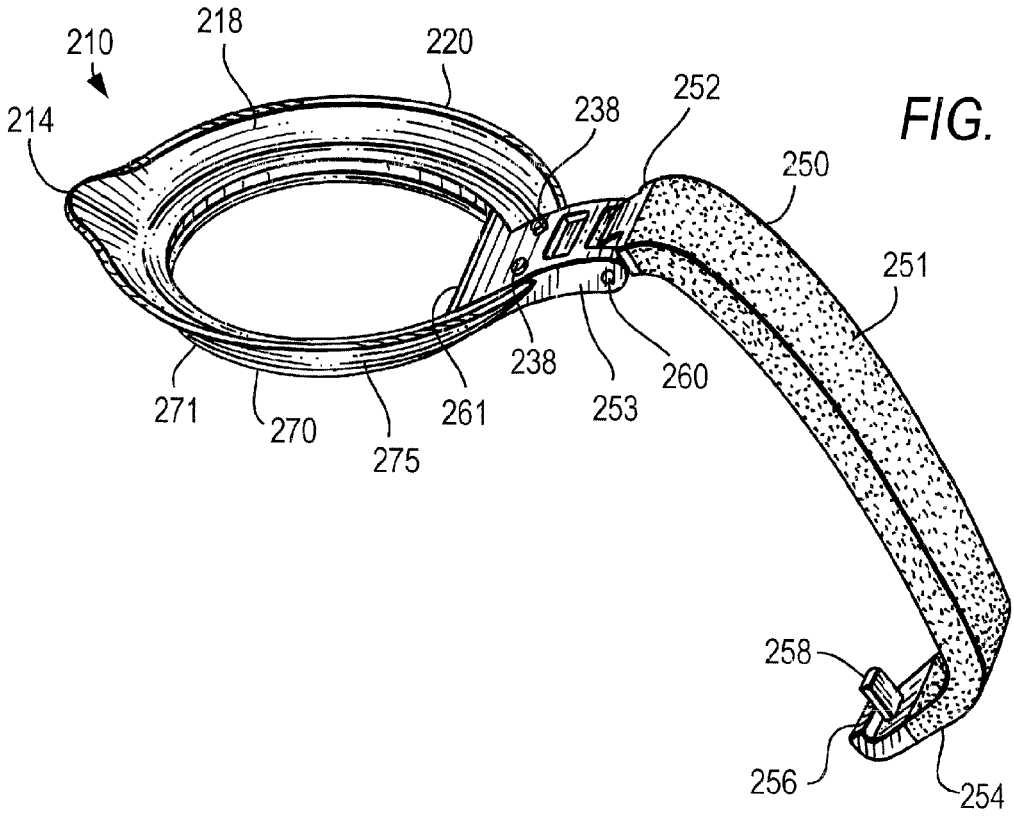
FIG. 17 is a perspective view of a preferred embodiment of the pouring spout with a pivoting handle separated from a paint can.
Figure 21:
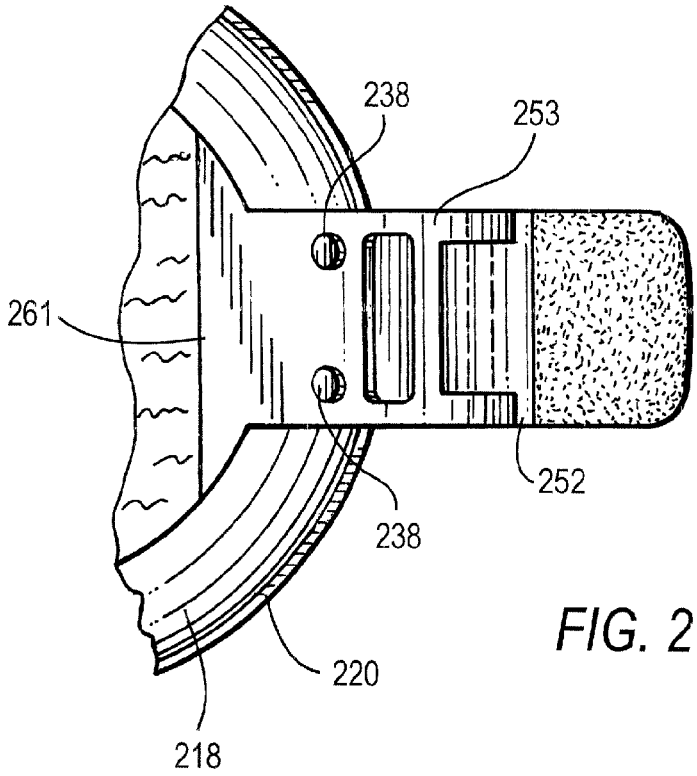
FIG. 21 is a top view of the hinge of the pouring spout with pivoting handle with a view taken along line 21-21 of FIG. 20.
Figure 18:
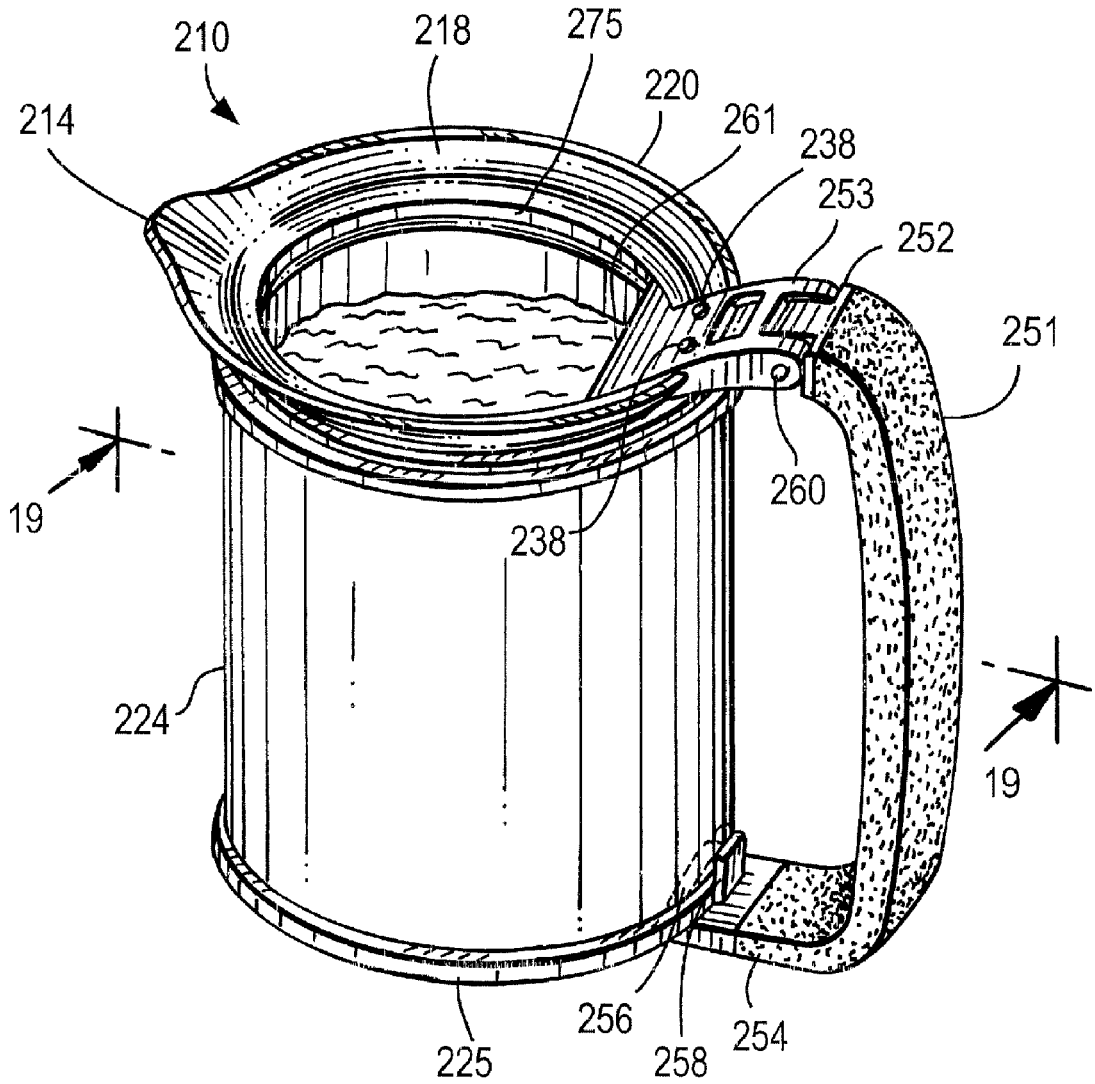
FIG. 18 is a perspective view of the pouring spout with a pivoting handle connected to a one-quart paint can at its opening, with the handle pivoted away from the paint can.
Figure 19:
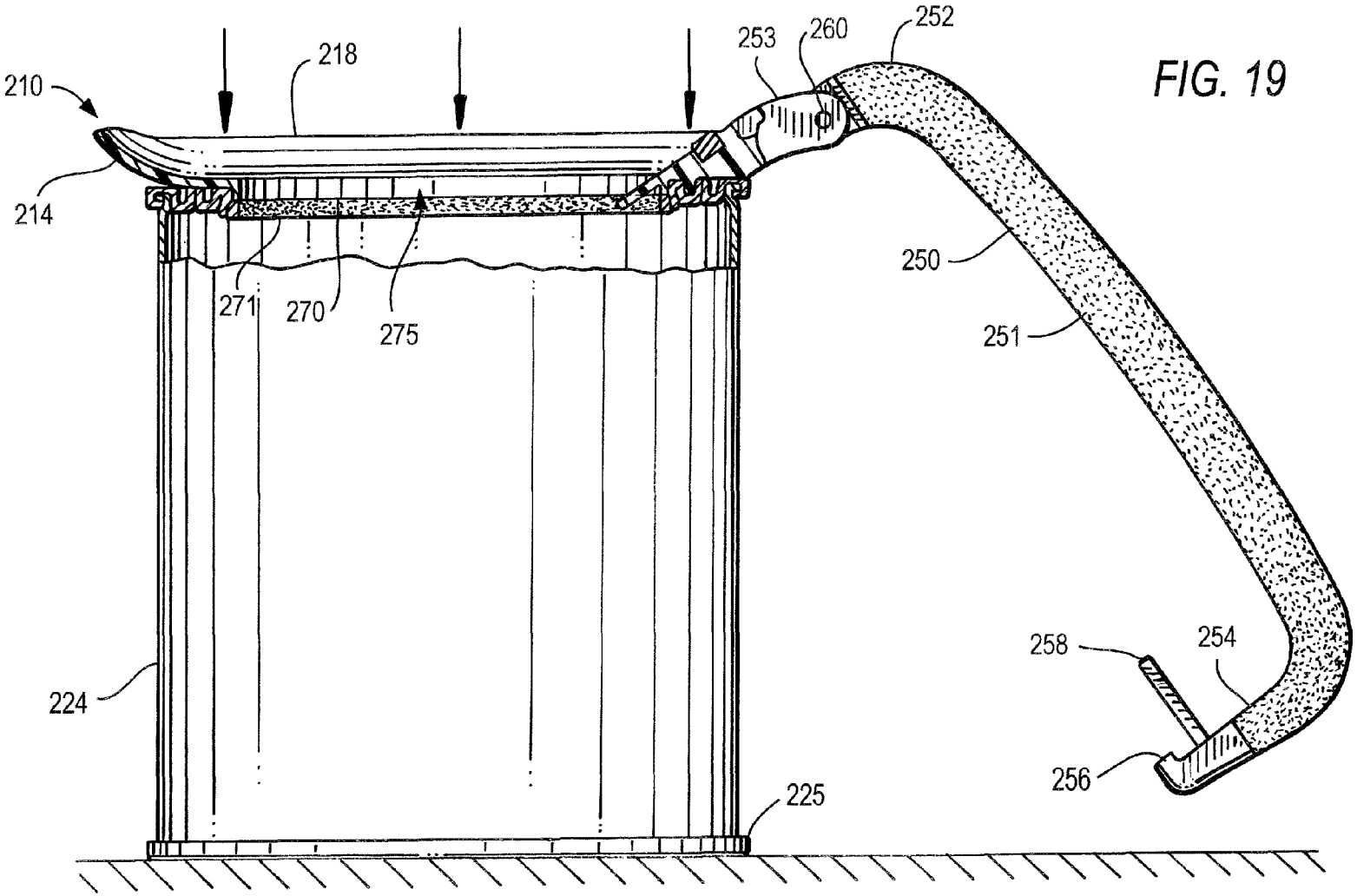
FIG. 19 is a cross sectional view of a pouring spout with a pivoting handle taken along line 19-19 of FIG. 18 with an arrow showing the arc of the handle.
Figure 20:
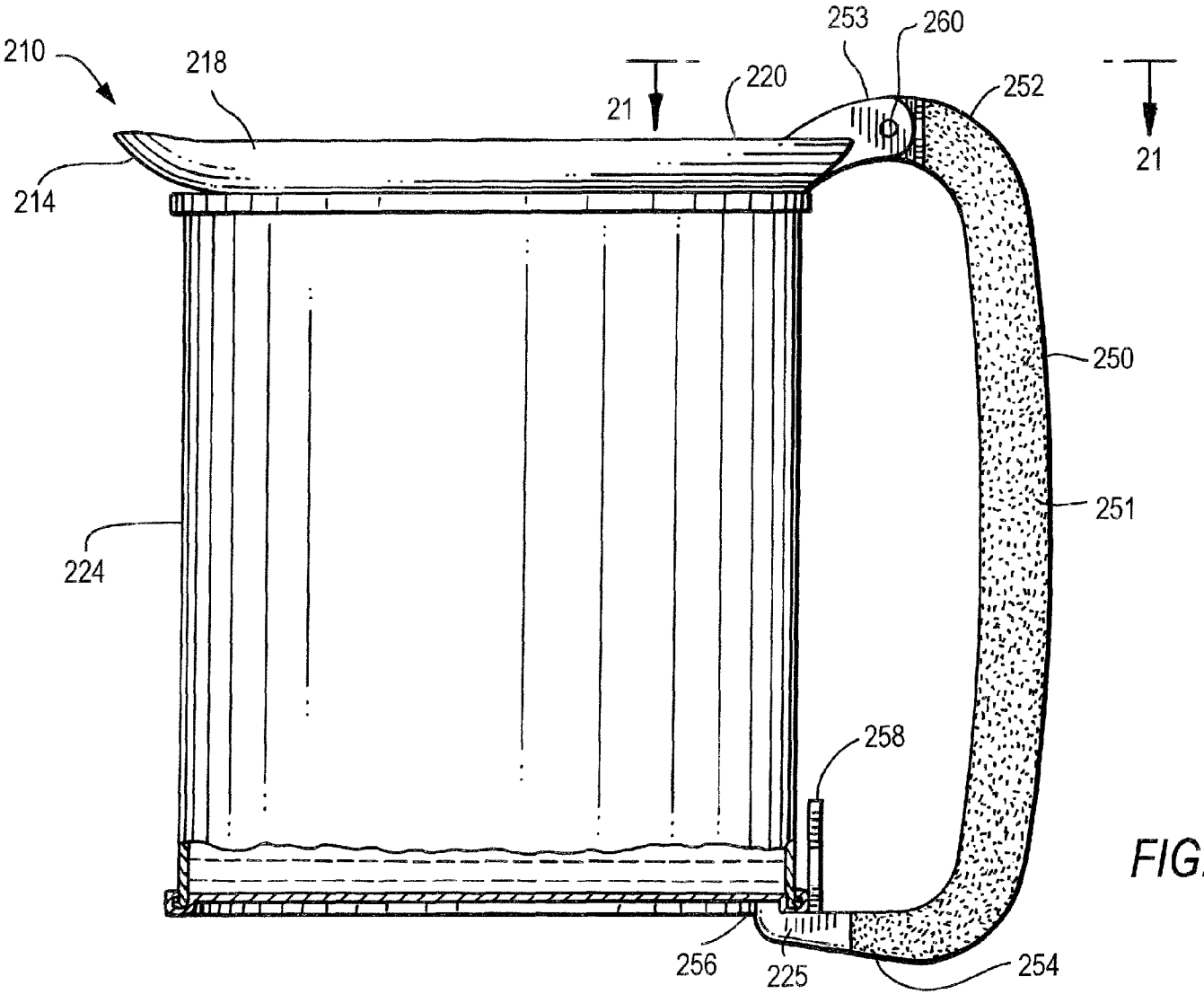
FIG. 20 is an side view of a pouring spout with a pivoting handle connected to a one-quart paint can at its opening, with the handle engaged to the bottom of the paint can which is depicted in a partial cross sectional view.

The bottom end (154) of the handle (150) includes two upwardly extending projections (156, 158), which cooperate with the bottom rim (125) of a standard, cylindrical paint container (124) so as to secure the pouring spout (110), and to lock in the bottom of the handle (150) of the spout (110) to the bottom rim (125) of the container (124), as shown in FIGS. 12, 15 and 16. In particular, in securing the bottom end (154) of the handle (150) to the rim of the paint container, the rim (125) is positioned between the cylindrical pin (158) and curved elevation (156) that is seated against the interior of the rim (125) of the pouring spout (110). Significantly, the curved lateral side of the elevation (158) contacting the interior portion of the rim (125) has a contour that corresponds to that of the rim (125) so that the elevation (158) and rim (125) may contact one another along the length of the elevation (158) when the bottom end (154) of the handle (150) is attached to the container (124). This provides for secure handling of the pouring spout (110) when it is attached to the container (124).

As shown in FIG. 15, since the bottom end (154) of the handle (150) is positioned beneath the rim (125) of the container (124), it causes the container to be slightly tilted when resting on a surface. Accordingly, it is important that the bottom end (154) not be excessively thick to help keep the container from tipping over. Of course, in addition to or instead of the two upwardly extending projections shown in the figures as an elevation (156) and pin (158), other forms of projections and means for securely attaching the bottom end (154) of the handle (150), including snap attachment means, hook and loop means and the like, may be utilized as well. Furthermore, the handle (150) may comprise elastic material, e.g. thermoplastic elastomeric material or rubber, to allow the handle to become elongated and snap to the bottom rim (125) of the paint container (124).

Once attached, a user can either hold the container (124) and spout (110) by the handle (150). Alternatively, a user can insert the hand in the space between the handle (150) and side of the container (124) and utilize the palm and fingers to hold the side of the container while part of the combined weight of the can (124) and spout (110) can also be distributed in a number of other areas of the hand as well, such as the area along the index finger and hand adjacent to the thumb and/or the top surface of the hand opposite the palm.

It should be understood that the pouring spout (110) may be adapted for use with other types of containers that are capable of holding liquids or other materials besides paint, and is not limited exclusively to be used in connection with paint containers.

The handle portion (150) is preferably provided with an overlay or handle cover (151) that is composed of a soft, flexible material that is preferably slip-resistant, easy and comfortable to grip, such as a thermoplastic elastomer (i.e., Santoprene®) or rubber. In addition, the same or a similar material is applied at the base (170) of the spout (110), forming, or covering, the sealing member (171). Particularly, in the context of a one-quart paint can which has a reduced-sized opening relative to the one-gallon counterpart, the soft material at the base (170) of the spout (110) yields significantly more than the rigid plastic, allowing the spout (110) to form a better and more secure seal at the opening of the paint can when the spout (110) is attached. In the preferred embodiment, the soft sealing member (171) becomes slightly compressed as it is inserted into the opening of the paint can (124). After passing through the opening, the sealing member (171), or a portion thereof, becomes decompressed thereby securely attaching the base (170) of the spout (110) to the container (124), independent of the upwardly extending projections (156, 158) at the bottom end (154) of the handle (150). Alternatively, the sealing member (171) may be constructed so as not to securely fasten the wall (118) of the spout (110), or bottom edge (170) thereof, at the opening of the container (124) independent of the bottom end (154) of the handle (150) that is secured to the rim (125) of the container (124). In such an embodiment, the sealing member (171) merely presses against the container (124) and works in conjunction with the upwardly extending projections (156, 158) at the bottom end (154) of the handle (150) to clamp the container between the sealing member (171) and bottom end (154) of the handle (150) to securely hold the container (124).

It should be understood that the pouring spout and handle may be formed in a variety of sizes to accommodate containers that are capable of holding different volumes and which have differently-sized openings. In the context of paint cans in particular, the pouring spout and handle is also easily adapted to accommodate other sizes, including one-pint, one-liter and half-gallon paint cans, in addition to the one-gallon and one-quart cans previously referenced.

Furthermore, it should be understood that the soft sealing member may be applied at a middle area of the wall (118) rather than at the base (170). It should also be understood that a groove or locking lip located at an outer surface of the wall may be provided instead of or in addition to the sealing member (171) at or near the base (170) of the spout (110) for engaging the spout (110) at the opening of the container (124). Likewise, a snap attachment means or other conventional attachment means known in the art may be provided as well.

Although preferred, it is not required to apply a thermoplastic elastomer, rubber or other soft material to the handle (150) and sealing member (171) of the spout (110), and it should be understood that the spout (110), including the entire handle portion (150) and sealing member (171) may be constructed from a single material, such as hard plastic.

In the preferred embodiment, the pouring spout (110) further carries a wiping surface (160) for removing excess paint which protrudes inwardly from the wall (118) of the spout (110), preferably opposite the mouth (114). The surface (160) is substantially flat, has a substantially straight edge and is preferably located beneath a removable lid or insert (12), see FIGS. 1 and 2, when a lid or insert (12) is provided. Optionally, a bridging strip (36), see FIGS. 3 through 6A, may be utilized instead of the wiping surface (160), if desired.

The pouring spout (110) may also include one or more magnets (138) for removably retaining the metallic ferrule of a paint brush. In the embodiment depicted in FIGS. 11 through 16, the magnets (138) are attached to the wall (118) at an interior surface thereof. Optionally, the magnets (138) may also be positioned on the wiping surface (160). Significantly, the magnets (138) are attached such that at least the top surface of each magnet (138) is exposed. By exerting their magnetic attraction to the metallic ferrule (142), the magnets (138) suspend a paintbrush (140) over the opening of the paint can (124), allowing paint from the brush (140) to drip into the interior of the can (124). In addition, magnets may be provided on the handle (150) for retaining the paint brush (140) before or after use.

The pouring spout (110) and handle (150) thereof are constructed by the process of injection molding, whereby a hard plastic, such as polypropylene is injected in heated liquid form into a mold and then cooled until forming a generally rigid skeleton in the basic form of the pouring spout (110) and handle (150) thereof. As noted above, during the molding process, the handle portion (150) is integrally molded to the wall (118) of the spout (110). However, the handle (150) may instead be constructed so that it is selectively detachable from, or attached to the remaining portion of the spout (110) after the handle (150) and pouring area of the spout (110) are each constructed.

After forming the generally rigid skeleton of the spout (110) by injection molding, it is placed in another mold for purposes of applying to the spout (110) the thermoplastic elastomer material or other material which sufficiently "gives" as the handle cover (151) and sealing member (171) of the spout (110). The handle covering (151) and soft sealing member (171) are applied to the skeleton of the spout (110) through an overmolding process whereby a heated thermoplastic elastomer or other similar material is applied in liquid form to the skeleton. Using this process forms a strong chemical bond between the soft thermoplastic elastomer material and hard plastic once the thermoplastic material cools, making it difficult to separate it from the hard plastic. Of course, other methods besides overmolding may be used to attach the handle covering (151) and sealing member (171) to the rigid spout skeleton. For example, the soft handle (151) and sealing member (171) may be simply attached by conventional mechanical fastening means such as a snap attachment of a soft cover. Moreover, as previously mentioned, the entire spout (110), including the handle (150) and sealing member (171) may be composed of a hard plastic, such as polypropylene. In addition, the handle area (150), or portion thereof, may be hollow to reduce the overall weight of the pouring spout (110) and to reduce the quantity of material required for manufacturing.

FIGS. 17 through 21 depict and relate to another preferred embodiment of the inventive pouring spout (210). This embodiment of the pouring spout (210) has many of the same features as the spout (110) depicted in FIGS. 11 through 16. For example, the spout (210) has a collar or circular base element (275) with a wall (218) extending generally upwardly therefrom and proceeding around and defining a central opening that is substantially aligned with the opening of a paint container (224). In this embodiment, the spout (210) also has a mouth (214) which extends forward and radially outward from the circular base (275) and wall (218) to which the mouth (214) is integrally connected, and a sealing member (271) at the lower edge or base (270) of the wall (218). The pouring spout (210) also includes a vertically-oriented, elongated, curved handle (250) that is located radially opposite the mouth (214) and having an overlay or cover (251), as described above in connection with the previous embodiment of the pouring spout (110). The pouring spout (210) also has a wiping surface (261) with magnets (238) for holding the metallic ferrule of a brush.

One improvement over the pouring spout with handle (11) described above is that the handle (250) of this embodiment is pivotally connected to the wall (218) of the pouring spout (210) with a hinge (260). Particularly, the top end (252) of the handle is pivotally attached to the wall (218) of the spout (210) by virtue of an extension (253) that projects rearward from the wall (218) to which the tope end (252) is joined by a hinge pin (260), which passes through aligned apertures in the extension (253) and top end (252).

Alternatively, the handle (250) may be pivotally attached at any other conventional location along the spout (210), including but not limited to, the inner or outer surface of the wall (218) of the spout (210), the upper rim (220), or a combination thereof. Moreover, while a single-pin hinge (260) is utilized to connect the top end (252) of the handle (250) to the wall (218), any type of conventional hinge known in the art, including but not limited to a live hinge, spring hinge and/or friction hinge, may also be utilized. Furthermore, it should be understood that a hinge may be oriented such that the handle is enabled to move to one side and/or the other (i.e., to the left and/or to the right) rather than backward and forward in the engaged position, as shown in FIGS. 17 through 20.

The hinged-handle pouring spout (210) enables engagement of the pouring spout (210) to a paint can (224) without having to contend with and/or counteract the natural tilting of a container that results, for example, during the application and use of the pouring spout with handle (110) when the bottom end (154) of the handle (150) is engaged to the rim (125). Some cumbersome and undesirable practices for circumventing this particular situation include attaching the pouring spout (110) when the can (124) is positioned on the edge of the surface or simply applying the spout (110) when the can (124) is tilted which may cause the can (124) to spill.

In this embodiment of the pouring spout with handle (210), the handle (250) is pivoted or folded away from a paint can (224) so that the paint can can rest flat on a surface. With the handle (224) in the "away" position, a user can easily apply downward force to the pouting spout (210) at attach it to the can (225) without interference by the handle (250) (which extends just below the bottom end of the paint can (224) when vertically-oriented), thus firmly lodging the sealing member (271) at or in the opening of the paint can (224). After appropriately positioning and securing the upper portion of pouring spout (210), a user then pivots the handle (250) toward the paint can (224) so that it is substantially vertical and secures the bottom end (254) of the handle (250) to the rim (225) of the paint can (224) with projections (256, 258), a position shown in FIG. 20.

It should also be understood that the top end of the handle may be integrally molded or otherwise fixedly attached to the all of the pouring spout while the hinge element may be positioned at a location along the length or mid-portion of the handle (i.e., ¼, ½ or ¾ etc. of the way down) so that only a portion of the handle is adapted to pivot or move. In this embodiment, the handle comprises mating or corresponding sections that together form a hinge when one or more pins are appropriately placed. Aside from the described embodiments, it should be understood that other appropriate means for employing a pivoting handle may be created with some modification(s).

Referring again to FIGS. 17 through 21, the bottom end (254) of the handle (250) includes two upwardly extending projections (256, 258), which cooperate with the bottom rim (225) of a standard, cylindrical paint container (224) so as to secure the pouring spout (210) as shown in connection with the other embodiment of the pouring spout (110) shown in FIGS. 12, 15 and 16. Here, the projection (258) of this embodiment of the pouring spout (210) extends upwardly at least even with and preferably beyond the height of the curved projection (256) seated interior of the rim (225) thus providing for a more secure hold of the paint can (224) between the projections.

Other features of the pouring spout with handle (210) aside from the pivoting handle (250) and hinge (260) are generally the same as or interchangeable with those of the other embodiment of the pouring spout with handle (110) discussed previously. For example, with either spout (110, 210) a user can hold a container by the either the handle and/or by inserting the hand between the handle and can wall so that the combined weight of the can and spout can also be distributed. Likewise, the spout (210) and its respective parts, such as the overlay (251), handle (250), sealing member (271) etc. may be fabricated in generally the same manner (i.e., injection molding) and with the same materials (i.e., thermoplastics, thermoplastic elastomers, polypropylene, rubber etc.) that are utilized in connection with the pouring spout with handle (110). Obviously, it should also be understood that the pouring spout (21) may be constructed in various sizes to accommodate containers of different sizes, measurements and shapes in addition to the configuration utilized to accommodate a one-quart container that is the preferred embodiment.

Although the invention is described in terms of particular embodiments, it is to be understood that the embodiments are merely illustrative of an application of the principles of the invention. Numerous modifications may be made and other arrangements may be devised without departing from the spirit and scope of the invention.

The invention claimed is:

1. A handle device for securely holding a cylindrical container carrying paint and facilitating pouring of paint from said container when said device is engaged to said container, said container including a circular groove at the top of said container, comprising:

a circular member having an opening and a base, wherein the circular member is adapted to attach to the top of said container and includes a circular sealing member at said base adapted to mate and form a seal with said circular groove;

a spout connected to and extending from said circular member;

a handle member having a top end, a bottom end and a mid-portion connecting said ends, said handle member being essentially rigid along said handle member length and said handle member top end being positioned opposite said spout, and being separate from said spout by a diameter of said opening; and a hinge connected to said handle member and to said circular member which enables said bottom end of said handle member to pivot between a position distant from said container and a position attached to said container, whereby when said handle member is in the attached position, said handle device holds said container between said circular member and said bottom end of said handle member;

wherein said handle member is substantially equidistant from said container, and when said handle member is in the attached position said handle member is positioned so as to facilitate the flow of paint out of said container in the direction of said spout and over said spout.

2. The handle device of claim 1, said circular member comprising a wall extending around at least a portion of said opening.

3. The handle device of claim 1, said spout extending radially outward from said circular member.

4. The handle device of claim 1, said hinge being positioned at said top end of said handle member.

5. The handle device of claim 1, said hinge being positioned along the mid-portion of said handle member.

6. The handle device of claim 1, the container having a bottom rim, said bottom end of said handle member comprising two cooperating projections that securely hold said rim of said container between said projections.

7. A handle device for securely holding a cylindrical container carrying fluid and facilitating pouring of fluid from said container when said device is engaged to said container, comprising:

a spout;

a wall having a base, said wall defining an interior opening of said device and said spout extending radially outward from said wall; and a handle member having a top end, bottom end and a mid-portion connecting said ends, said handle member being positioned opposite said spout, and being separate from said spout by a diameter of said interior opening;

a hinge connected to said handle member and said wall that allows said handle member to pivot back and forth;

wherein said handle member and said base cooperate to hold said container when the device is engaged to said container, whereby when said handle member is engaged to said container said handle member facilitates the flow of fluid along the diameter in the direction of said spout and over said spout.

8. The handle device of claim 7, said base comprising a sealing member for creating a seal between said device and said container.

9. The device of claim 8 said sealing member comprising a thermoplastic elastomer.

10. The handle device of claim 7 further comprising a wiping surface interior of said wall near said base and opposite said spout.

11. The handle device of claim 7, said hinge being positioned at said top end of said handle member.

12. The handle device of claim 7, said hinge being positioned along the mid-portion of said handle member.

13. The handle device of claim 7, the container having a bottom rim, said bottom end of said handle member comprising at least one projection seated beside said rim of said container when said device is engaged to said container.

14. The device of claim 7, said wall comprising a locking lip located along an outer surface of said wall, said lip capable of engaging a rim of said container.

15. The device of claim 7 said handle member comprising a soft cover.

16. The device of claim 15 said handle member comprising a thermoplastic elastomer.

17. The device of claim 15 said handle member comprising rubber.

18. The device of claim 7, wherein said fluid is paint and said container is a standard rigid, cylindrical paint can, wherein said device is adapted to be used with said standard rigid, cylindrical paint can.

19. A handle device for securely holding a cylindrical container carrying fluid and facilitating pouring of fluid from said container when said device is engaged to said container, comprising:

a walled member having an aperture and a base that is fitted to an opening of said container;

a handle member having a upper portion and a lower portion, said handle member being attached to said walled-member with a hinge at said upper portion of said handle member, said hinge enabling said handle member to pivot back and forth; and a mouth extending from said walled member, said mouth being positioned opposite said handle member, and being separate from said spout by a diameter of said opening;

wherein said container is held securely between said base of said walled-member and said lower portion of said handle member, whereby when said handle member is attached, said handle member facilitates the flow of fluid along the diameter in the direction of said spout and over said spout.

20. The handle device of claim 19, said base comprising a sealing member for creating a seal between said device and said container.

21. The handle device of claim 20 said sealing member comprising a thermoplastic elastomer.

22. The handle device of claim 19, said lower portion of said handle member comprising a plurality of cooperating projections that securely hold said container.

23. The handle device of claim 19, said walled-member comprising a locking lip located along an outer surface of said walled-member, said lip capable of engaging a rim of said container.

24. The device of claim 19 said handle member comprising a soft cover.

25. The device of claim 24 said handle member comprising a thermoplastic elastomer.

26. The device of claim 24 said handle member comprising rubber.

27. The device of claim 19, wherein said fluid is paint and said container is a standard rigid, cylindrical paint can, wherein said device is adapted to be used with said standard rigid, cylindrical paint can.

28. The device of claim 19, wherein said device is selectively attachable and detachable.

29. A device for pouring a liquid away from a container and gripping the container, comprising:

a base having a deformable thermoplastic sealing member;

a wall extending upward from said base, said wall defining an interior area of said device;

a mouth extending radially outward from said wall;

a handle positioned opposite said mouth and being separate from said mouth by a diameter of said opening, said handle being hingedly attached to said wall and adapted to pivot back and forth relative to said container when said device is in use;

a plurality of projections extending from said handle, said projections cooperating with said base to secure said container when said device is in use, whereby when said handle is secured to said base, said handle facilitates the flow of liquid along the diameter in the direction of said mouth and over said mouth.

* * * * *